US011788448B2

(12) United States Patent
Blas Martinez et al.

(10) Patent No.: US 11,788,448 B2
(45) Date of Patent: Oct. 17, 2023

(54) VEHICLE EXHAUST SYSTEM WITH SILENCER HAVING EXHAUST JET DEFLECTOR

(71) Applicant: FORD GLOBAL TECHNOLOGIES, LLC, Dearborn, MI (US)

(72) Inventors: Luis Felipe Blas Martinez, Jilotepec (MX); Ricardo Daniel Sanchez Lugo, Texcoco (MX); Miguel Angel Leon Guerrero, Ecatepec de Morelos (MX); Virginia Ortega Conde, Alvaro Obregon (MX); Kristian Ulyses Flores Aviña, Anáhuac i Seccion (MX); Lucas Apandi Phan, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 137 days.

(21) Appl. No.: 17/215,826

(22) Filed: Mar. 29, 2021

(65) Prior Publication Data

US 2022/0307399 A1 Sep. 29, 2022

(51) Int. Cl.
*F01N 1/08* (2006.01)
*G10K 11/16* (2006.01)

(52) U.S. Cl.
CPC ..... *F01N 1/08* (2013.01); *G10K 11/161* (2013.01)

(58) Field of Classification Search
CPC ..... F01N 1/08; F01N 1/084; F01N 2260/20; G10K 11/161
See application file for complete search history.

(56) References Cited

U.S. PATENT DOCUMENTS

| | | | | |
|---|---|---|---|---|
| 4,735,283 | A | 4/1988 | Macaluso | |
| 4,809,812 | A * | 3/1989 | Flugger | F01N 1/083 181/275 |
| 10,393,003 | B2 | 8/2019 | Nowka et al. | |
| 2020/0102876 | A1 * | 4/2020 | Asano | F01N 1/083 |

FOREIGN PATENT DOCUMENTS

| | | | |
|---|---|---|---|
| CN | 102207016 | A * | 10/2011 |
| EP | 1512852 | B1 | 9/2008 |
| JP | H05332129 | A * | 12/1993 |
| JP | 2018044446 | A * | 3/2018 |
| JP | 2019019677 | A * | 2/2019 |

OTHER PUBLICATIONS

English translation of JP-2019019677-A, accessed Oct. 7, 2022 in USPTO Search tool (Year: 2019).*
English translation of JP-H05332129-A, accessed Oct. 7, 2022 in USPTO Search tool (Year: 1993).*
English translation of JP-2018044446-A, accessed Oct. 7, 2022 in USPTO Search tool (Year: 2018).*
English translation of CN-102207016-A accessed Oct. 7, 2022 in USPTO Search tool (Year: 2011).*

* cited by examiner

*Primary Examiner* — Jeremy A Luks
(74) *Attorney, Agent, or Firm* — Vincent Mastrogiacomo; Brooks Kushman P.C.

(57) ABSTRACT

An exhaust silencer includes a housing defining an interior and a tube disposed in the interior and defining an opening. A gas-flow deflector is configured to heat shield an interior wall of the housing from exhaust gases exiting the opening. The deflector has a deflector plate and a riser. The riser has a first portion connected to the interior wall and a second portion connected to a backside of the deflector plate to suspend the deflector plate in the interior such that the backside is completely spaced from the interior wall to form an insulating airgap therebetween.

4 Claims, 3 Drawing Sheets

VEHICLE EXHAUST SYSTEM WITH SILENCER HAVING EXHAUST JET DEFLECTOR

TECHNICAL FIELD

This disclosure relates to exhaust silencers for vehicle exhaust system and more particularly to shielding one or more components of the exhaust silencer from exhaust jets.

BACKGROUND

Motor vehicles may include an engine that combusts fuel to produce power. Byproducts of combustion include noise and exhaust gases. An exhaust system is provided to reduce noise and carry the exhaust gases away from the vehicle. The exhaust system may include one or more exhaust silencers, such as resonators or mufflers, to reduce a noise level of the vehicle.

SUMMARY

According to one embodiment, a vehicle exhaust system includes an exhaust silencer. The silencer includes a housing defining an interior and a tube disposed in the interior and having an opening. A gas-flow deflector is disposed in the interior in alignment with the opening such that a jet of exhaust gases exiting the opening contacts the deflector to provide heat shielding to a wall of the housing. The deflector has a deflector plate with a front side facing the opening and a backside completely spaced from the wall of the housing.

According to another embodiment, an exhaust silencer includes a housing defining an interior and a tube disposed in the interior and defining an opening. A gas-flow deflector is configured to heat shield an interior wall of the housing from exhaust gases exiting the opening. The deflector has a deflector plate and a riser. The riser has a first portion connected to the interior wall and a second portion connected to a backside of the deflector plate to suspend the deflector plate in the interior such that the backside is completely spaced from the interior wall to form an insulating airgap therebetween.

According to yet another embodiment, an exhaust silencer includes a housing and a transverse wall disposed in the housing and defining a pair of chambers. A tube having an opening is configured to expel an exhaust jet towards the transverse wall. A deflector is attached to the transverse wall and is disposed within a path of the jet to redirect the jet away from the transverse wall.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
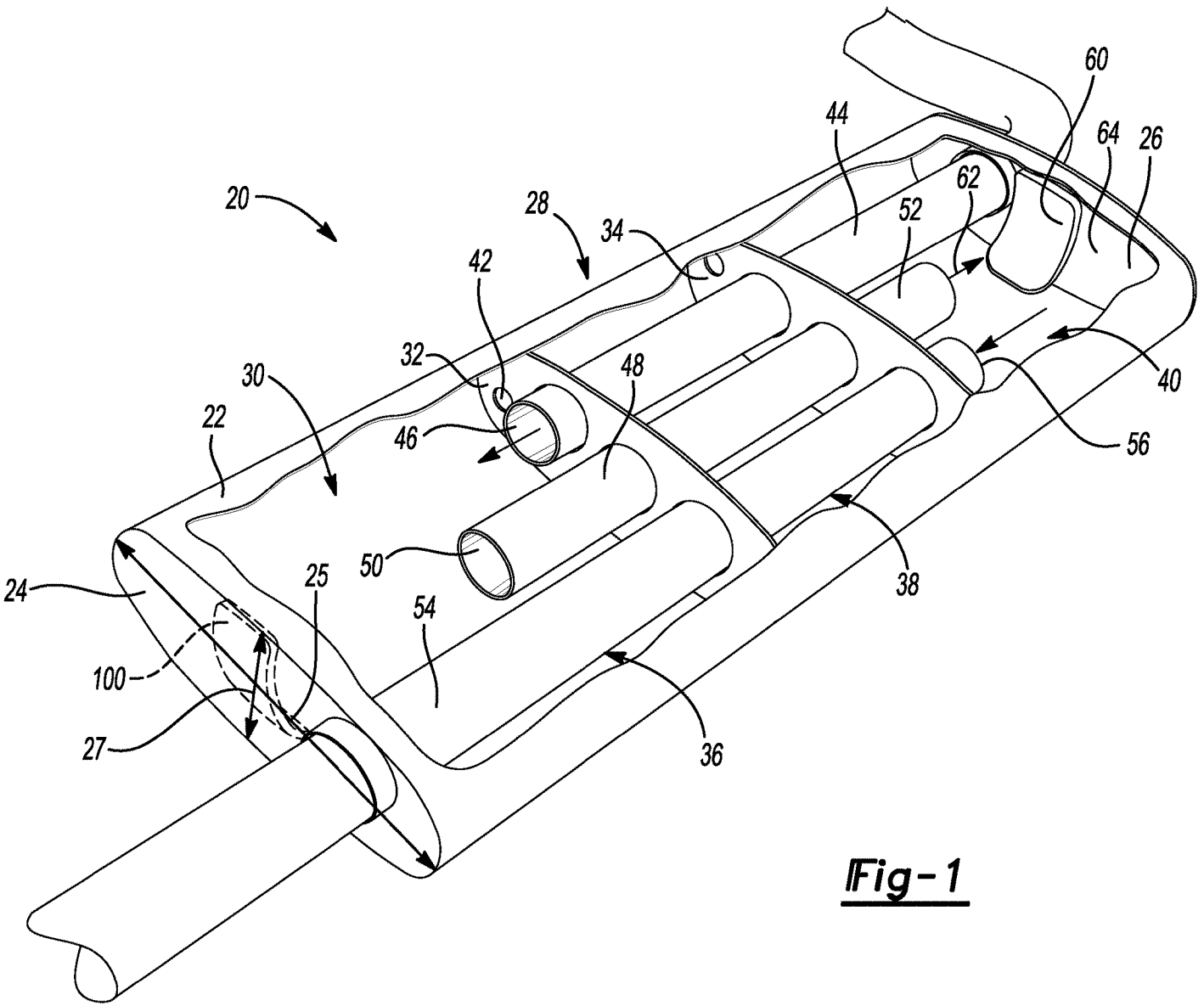
FIG. 1 is a perspective, cutaway view of an exhaust silencer.

Referring to FIG. 1, an exhaust silencer 20, e.g., a muffler or resonator, may include a tubular shell 22 enclosed by a pair of opposing headers 24, 26 to form a housing 28. The housing 28 may be formed of metal. The tubular shell 22 may be attached to the headers by welding or other joining technique. The tubular shell 22 has an ovular cross section in the illustrated embodiment, however, other cross-sectional shapes may be used. The ovular shell 22 may have a major axis 25 that is typically horizontal when the silencer is installed on the vehicle and a minor axis 27 that is typically vertically when the silencer is installed on the vehicle.

The housing 28 defines an interior 30 bounded by inner walls of the shell 22 and headers 24, 26. One or more partitions, such as partitions 32 and 34, are disposed within the interior 30 to form acoustic chambers, such as chambers 36, 38, and 40. The partitions (which may also be known as baffles) may be transverse walls that are oriented orthogonal to the longitudinal direction of the housing 28. The transverse walls may be formed of metal and are joined to the shell 22 such as by welding or the like.

The headers 24, 26 and the partitions 32, 34 have aligned openings 42 for receiving tubes therethrough. Each of the openings may include a collar or flange surrounding a periphery of the opening. In the illustrated embodiment, the silencer 20 uses a retroverted gas flow path to provide sound attenuation. Exhaust gases enter the housing 28 through an inlet tube 44 that extends through the front header 26 and the partitions 32 and 34. The inlet tube 44 defines an opening 46 that expels a jet of exhaust gases into the rear chamber 36. An internal tube 48 defines an inlet opening 50 disposed in the rear chamber 36 and an outlet opening 52 disposed in the front chamber 40. The internal tube 48 connects the chambers 36 and 40 in acoustic and fluid communication. An outlet tube 54 extends from an inlet opening 56 through the partitions 32, 34 and out of the housing 28 through the rear header 24. Portions of one or more of the tubes 44, 48, and 54 may be perforated in select locations. During operation of the engine, exhaust gases enter into the silencer 20 through the inlet tube 44 creating a high-pressure zone in the rear chamber 36. The exhaust gases then travel through the internal tube 48 to the front chamber 40. The outlet tube 54 carries the exhaust gases from the front chamber 40, through the middle chamber 38 and the rear chamber 36, and out of the silencer 20 to a downstream exhaust pipe. While not shown, sound deadening materials, such as glass fiber pack, may be disposed within one or more areas of the interior 30.

Exhaust gases, which are hot and under pressure, jet from the openings of the tubes and contact interior surfaces of the housing. The interior surfaces opposite the openings receive the brunt of the high-velocity and high-heat exhaust jet. These interior surfaces become hot spots and are more prone to premature wear than other areas of the silencer 20 due to thermal fatigue, corrosion, and the like.

The housing material subjected to high thermal cycles may experience dry corrosion mechanisms. In a high-temperature oxidizing environment, chemical reactions may form a protective oxide layer for a period of time, which eventually gives way to spalling and scaling. The high-temperature oxidizing environment may also form a non-protective oxide that promotes oxygen penetration into the metal leading to internal oxidation, which may render the material brittle. Additionally, most oxides have different coefficients of thermal expansion than the metal housing creating thermal stresses when the temperature changes. The differential thermal expansion may cause fragments of the oxides to break away from the housing promoting metal loss. These loose fragments may also rattle and/or cause blockages within the silencer.

Figure 2:
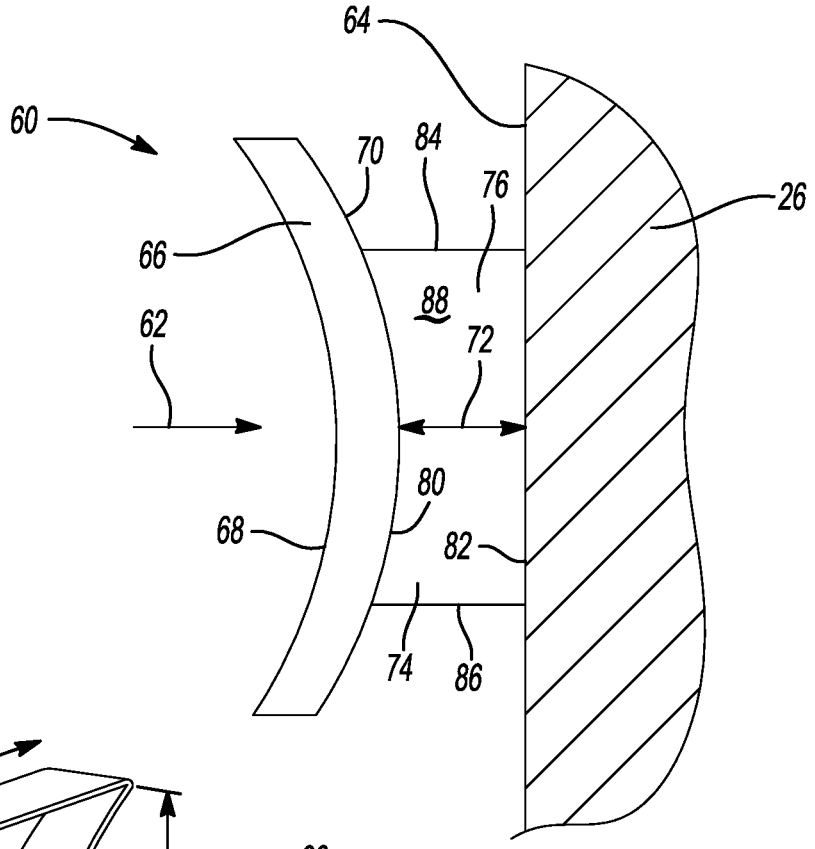
FIG. 2 is a detail view of a deflector of the exhaust silencer according to one or more embodiments.

Referring to FIGS. 1 and 2, the silencer 20 may include one or more gas-flow deflectors configured to shield portions of the housing 28 from the exhaust jets and reduce the above-described detrimental effects of hotspots. The one or more deflectors may be placed in locations aligned with the exhaust jets, i.e., within the flow path of the jet. In the illustrated embodiment, a first deflectors 60 is within the flow path of the jet 62 exiting the opening 52 of the internal tube 48. The deflector 60, inter alia, inhibits the jet 62 from contacting the interior wall 64 of the front header 26 to provide heat shielding and reduce hotspots.

The deflector 60 may include a deflector plate 66 having a front side 68 and a backside 70. The front side 68 faces the exhaust jet 62 and is configured to redirect the jet 62 away from the interior wall 64. To lesson thermal conduction, the deflector plate 66 is spaced from the interior wall 64 to form an insulating air gap 72 between the backside 70 and the wall 64. The deflector plate 66 may be attached to the header 26 by a riser 74. The riser 74 and the deflector plate 66 may be separate components that are joined together by welding, fasteners, mechanical joining, or the like. The riser 74 may have an elongate body 76 having a generally rectangular shape. In the illustrated embodiment, the riser 74 includes a first edge 80 attached to the backside 70 of the deflector plate 66, a second edge 82 attached to the wall 64, a top 84, a bottom 86, and opposing faces 88 that extend vertically from the top 84 to the bottom 86 and extend laterally from the first edge 80 to the second edge 82. The riser 74 may include a height defined between the top and the bottom, a width defined between the first and second edges, and a thickness defined between the faces. In the illustrated example, the riser 74 is substantially wider than it is thick and is substantially taller than it is wide forming a thin, slender rectangular prism. This, of course, is only one example, and the riser may have any suitable shape for suspending the deflector plate 66 in the flow path of an exhaust jet and spaced apart from a wall of the housing.

The deflector plate 66 may be curved to have a generally concaved shape on the front side 68 as shown in FIG. 2. The curvature may be a circular arc. The backside 70 may have a matching convex shape, or in other embodiments, may be a flat. The curved deflector plate 66 may be oriented to curve vertically within the housing 28. That is, a secant line of the curved front side 68 extends substantially parallel to the minor axis 27. Other orientations are also contemplated.

Figure 3:
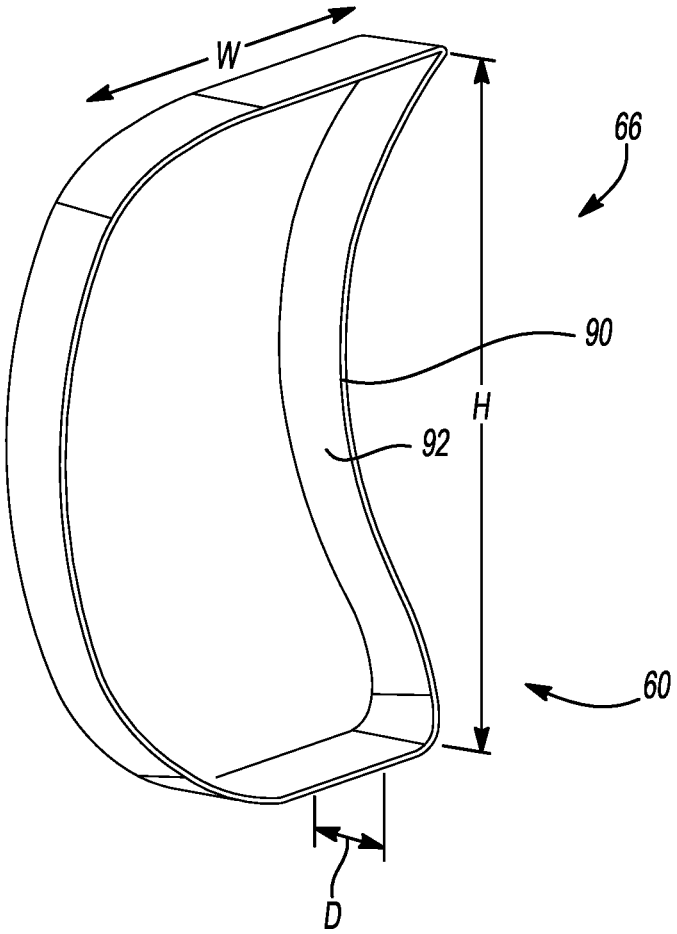
FIG. 3 is a perspective view of a deflector according to one or more embodiments.

Referring to FIG. 3, the deflector plate 66 may include a height dimension (H), a width dimension (W), and a depth dimension (D). The height (H) may be larger than the width (W) to provide increased size in the direction of the curvature, which is in the height direction in this embodiment. The width dimension (W) may approximate the spread of the jet to prevent hot exhaust gases from contacting the interior wall located behind the deflector. The height dimension may be larger than the spread of the jet to account for the redirection of exhaust gases along the curved surface of the front side 68.

FIG. 3 illustrates the deflector 60 with an optional cupped edge 90. (The optional cupped edge 90 is not shown in FIG. 2.) The cupped edge 90 may surround a complete perimeter of the deflector plate 66 or only be on select sides. The cupped edge 90 may include one or more walls 92 that extend forwardly from the front surface 68. In some embodiment, the cupped edge 90 may only be located at the ends of the curve, e.g., the top and bottom sides of FIG. 3, or may only be located on the lateral side. In some embodiments, only one cupped edge may be needed. The cupped edges inhibit the exhaust jet from redirecting into other portions of the housing and instead redirect the exhaust jet back into the void space of the chamber.

Referring back to FIG. 1, the silencer 20 may include another deflector 100 that is within the exhaust gas flow path of the jet emanating from the inlet tube 44. The deflector 100 may have a structure that is the same as or similar to the deflector 60. Alternatively, the deflector 100 may be sized and shaped differently than the deflector 60 depending upon the spread and temperature of the jet associated with the inlet tube 44. For example, the deflector 100 may be larger than the deflector 60 to account for the increased heat and velocity of the jet exiting tube 44, which is from the engine. The deflector 100 is attached to the interior wall of the header 24 by a riser (not shown).

The size, shape, and location of the deflectors 60 and 100 merely illustrate an example configuration of an exhaust silencer. These parameters are dependent upon the specific design of the exhaust flow path through the silencer and other locations, shapes, orientation, and sizes of the deflectors is contemplated. Additionally, while two deflectors are shown in the illustrated embodiment of FIG. 1, the silencer 20 may include only a single deflector, or may include three or more deflectors as needed. The deflectors 60, 100 shield the housing (the headers 24, 26 in the illustrated instance) from direct contact with the exhaust jet to reduce hotspots and prolong the life of the silencer 20.

Reducing the heat exposure of the housing 28 may also provide overall vehicle benefits in addition to the silencer itself. Silencers are packaged under the vehicle in close proximity to many other vehicle components such as brake lines, electronics, powertrain components, and the like. Extensive heat shielding is frequently provided to protect these components from the silencer. By employing the above-described deflectors, the surface temperature of the silencer may be reduced resulting in decreased need for heat shielding. This may provide an opportunity for cost reduction in the overall vehicle package. High-temperature hotspots may cause welding failure, leading to vibrations and noise. The proposed disclosure aims to reduce this failure. The proposed deflectors may also homogenize temperature of the silencer.

Figure 4:
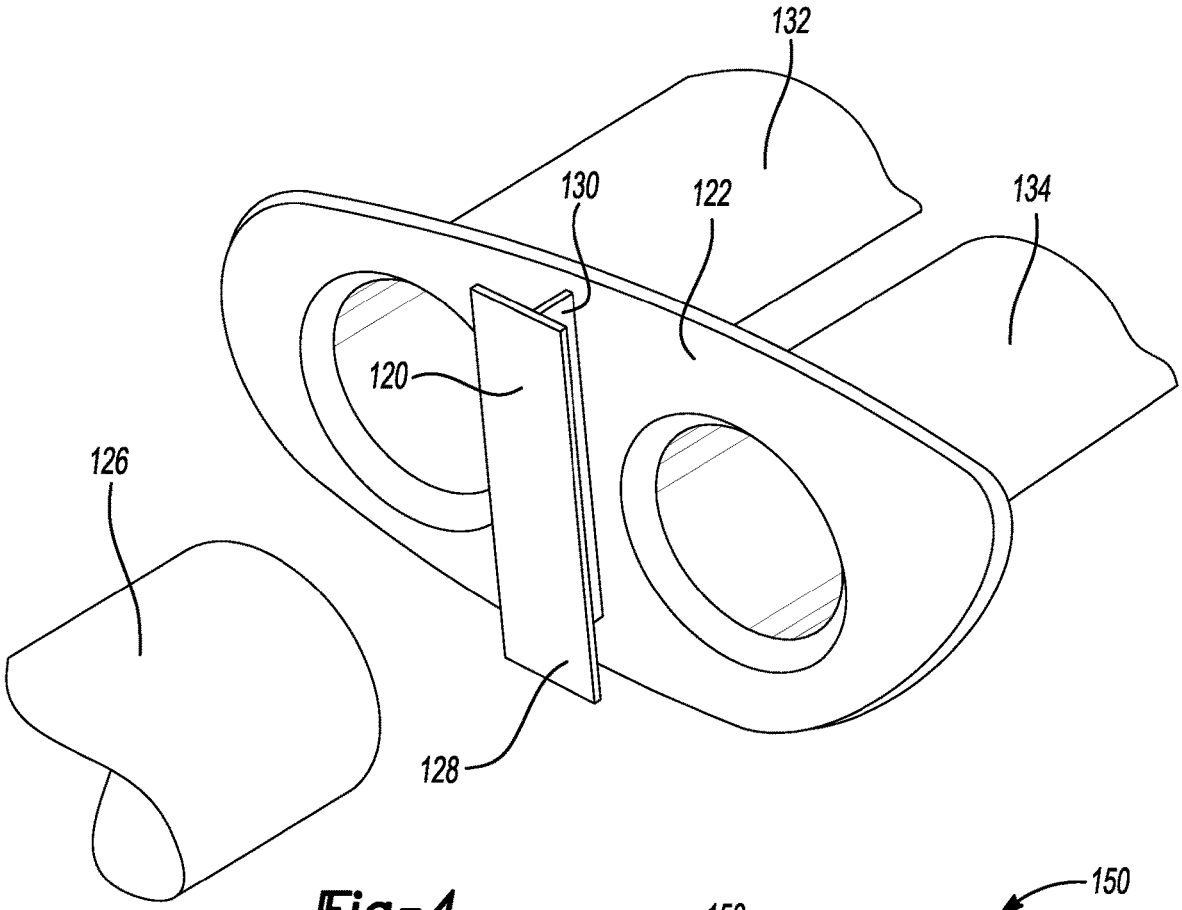
FIG. 4 is a partial perspective view of another exhaust silencer.

FIG. 4 illustrates another potential location for the deflectors. In this embodiment, a deflector 120 is attached to a partition 122 of the silencer. In this instance, the partition 122 is located within the exhaust gas jet of tube 126. The deflector 120 protects the partition 122 from the jet. The deflector 120 includes a deflector plate 128 that is spaced from the partition 122 by a riser 130. The riser 130 connect between a backside of the deflector plate 128 and the partition 122 to form an air gap as described above. The deflector plate 128 and the riser 130 function similar to the deflector described above. Here, however, the deflector plate 128 is not curved. Instead, the deflector plate 128 is a flat plate such as the elongated rectangle plate shown. The deflector plate 128 is taller than it is wide to fit between the tubes 132 and 134 that extend through the partition 122.

Figure 5:
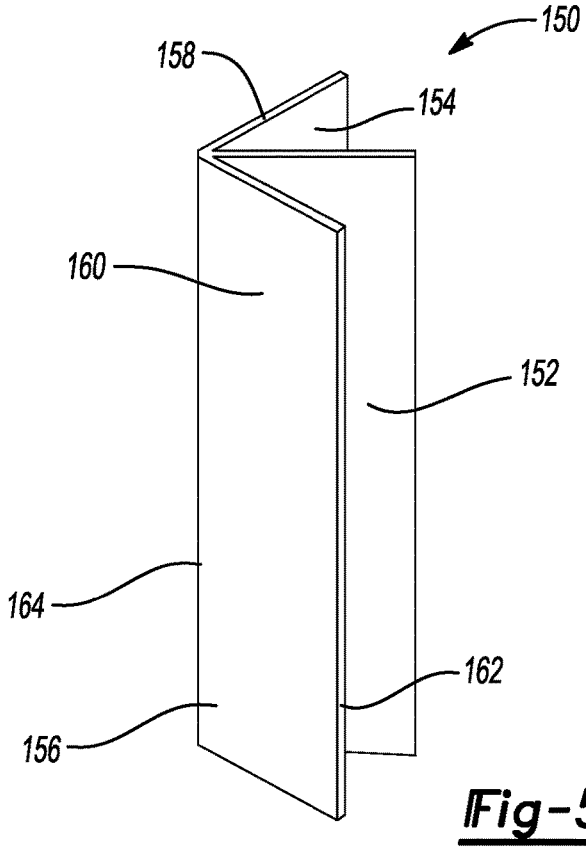
FIG. 5 is a perspective view of a deflector according to one or more alternative embodiments.

FIG. 5 illustrates a deflector 150 according to an alternative embodiment. The deflector 150 may be used in any of the above described locations within the exhaust silencer. The deflector 150 includes a riser 152 which may have a structure similar that described above with regards to riser 74. The deflector plate 154 rather than being a curved or flat panel includes a pair of panels 156 and 158 that are joined to create a generally vee-shaped deflector. Each of the panels may be a planar sheet having opposing faces 160 and edges 162 extending therebetween. One of the edges of each of the panels 156, 158 are joined together to form a vertex 164 that faces the exhaust jet. The angle formed between the panels may be increased or decreased to tune the redirection of gases. In the illustrated embodiment, the riser 152 is attached to the deflector plate 154 at the vertex 164. However, the riser may also be joined to a backside of one of the panels 156, 158. Similar to the above deflectors, the deflector plate 154 is spaced apart from the housing to form an insulating air gap.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. An exhaust silencer comprising:

a housing;

a transverse wall disposed in the housing and defining a pair of chambers;

a tube having an opening configured to expel an exhaust jet towards the transverse wall; and a gas-flow deflector disposed in one of the chambers in alignment with the opening such that a jet of exhaust gases exiting the opening contacts the deflector to provide heat shielding to the transverse wall, wherein the deflector includes:

a riser attached to the traverse wall;

a first rectangular panel attached to the riser, a second rectangular panel attached to the riser and to the first panel such that the first and second panels are angled relative to each other and are joined long a common vertex that faces the opening.

2. The exhaust silencer of claim 1, wherein first and second panels are angled at an acute angle.

3. The vehicle exhaust silencer of claim 1 further comprising:

a second deflector disposed within the housing and including a second deflector plate configured to shield a portion of the housing from another jet of exhaust gases.

4. The vehicle exhaust silencer of claim 3 further comprising a second tube having an opening in alignment with the second deflector and configured to direct the another jet at the second deflector plate.

* * * * *